US008394439B2

(12) United States Patent
Karabinis

(10) Patent No.: US 8,394,439 B2
(45) Date of Patent: Mar. 12, 2013

(54) MIXING FIRST AND SECOND SUBSTANCES RESPONSIVE TO OPENING OF A CONTAINER

(75) Inventor: Dimitrios P. Karabinis, Cary, NC (US)

(73) Assignee: EICES Research, Inc., Cary, NC (US)

( * ) Notice: Subject to any disclaimer, the term of this patent is extended or adjusted under 35 U.S.C. 154(b) by 477 days.

(21) Appl. No.: 12/563,393

(22) Filed: Sep. 21, 2009

(65) Prior Publication Data

US 2010/0084021 A1 Apr. 8, 2010

Related U.S. Application Data

(60) Provisional application No. 61/103,451, filed on Oct. 7, 2008.

(51) Int. Cl.

| | |
|---|---|
| ***B65D 81/34*** | (2006.01) |
| ***B65D 5/50*** | (2006.01) |
| ***B65D 81/32*** | (2006.01) |
| ***B65D 77/02*** | (2006.01) |
| ***B65D 1/04*** | (2006.01) |
| ***B65D 69/00*** | (2006.01) |
| ***B65D 1/24*** | (2006.01) |
| ***B65D 1/36*** | (2006.01) |
| ***B65D 25/04*** | (2006.01) |
| ***B65D 57/00*** | (2006.01) |
| ***B65D 85/00*** | (2006.01) |

(52) U.S. Cl. ..... 426/394; 426/119; 426/120; 426/108; 215/6; 215/DIG. 8; 206/568; 220/501; 220/502; 220/503; 220/555

(58) Field of Classification Search ..... 426/394, 426/108, 119, 120, 115, 131, 390; 215/6, 215/DIG. 8, 10; 206/219, 222, 568, 227; 220/501, 502, 503, 505, 555

See application file for complete search history.

(56) References Cited

U.S. PATENT DOCUMENTS

| | | | | |
|---|---|---|---|---|
| 3,779,372 | A * | 12/1973 | de Lloret | 206/222 |
| 4,531,656 | A | 7/1985 | Nitchman et al. | |
| 5,984,141 | A | 11/1999 | Gibler | |
| 6,390,292 | B2 | 5/2002 | Hawthorne | |
| 6,719,130 | B1 * | 4/2004 | Wagner | 206/222 |

OTHER PUBLICATIONS

Irish car bomb recipe, http://web.archive.org/web/20060818091401/ http://www.drinknation.com/drink/Irish-Car-Bomb, Oct. 31, 2004.*

* cited by examiner

*Primary Examiner* — Rena Dye
*Assistant Examiner* — Danny Chen
(74) *Attorney, Agent, or Firm* — Myers Bigel Sibley & Sajovec, P.A.

(57) ABSTRACT

This invention relates to containers that include at least one sub-container and to methods and/or systems for mixing first and second substances responsive to opening of the containers and the at least one sub-container that is included therein. The invention advantageously provides methods, systems, containers, sub-containers, seals and/or tethers that may be used in storing first and second substances in an unmixed state, until it is desired to mix the first and second substances just before utilization thereof.

20 Claims, 4 Drawing Sheets

- A two tether embodiment

FIG. 1 - Container and sub-container closed

FIG. 2- Container and sub-container opened

- Container and sub-container closed

- Container and sub-container open

- A two tether embodiment

MIXING FIRST AND SECOND SUBSTANCES RESPONSIVE TO OPENING OF A CONTAINER

CROSS-REFERENCE TO RELATED APPLICATION

This application claims the benefit of Provisional Application Ser. No. 61/103,451, entitled Mixing First and Second Substances Responsive to Opening of a Container, filed Oct. 7, 2008, the disclosure of which is hereby incorporated herein by reference in its entirety as if set forth fully herein.

FIELD OF THE INVENTION

This invention relates to containers such as beverage containers.

BACKGROUND OF THE INVENTION

An "Irish car bomb" is an alcoholic drink wherein a relatively small glass containing Irish cream is dropped into a larger glass containing beer, thus allowing mixing of the Irish cream and beer, followed by drinking of the mixed substance. The mixing of the Irish cream with the beer is done at the last minute, prior to drinking, to avoid a loss in flavor and/or in appearance of the mixed substance that may occur if there is a longer lapse of time between the mixing and the drinking.

SUMMARY OF THE INVENTION

Some embodiments of the present invention provide a method of mixing a first substance that is contained within a container with at least one second substance that is contained within at least one sub-container that is rigidly attached to the container and is contained within the container, the method comprising: opening a seal of the container; and opening at least one seal of the at least one sub-container that is rigidly attached to the container and is contained within the container, responsive to the opening a seal of the container.

In some embodiments, the seal of the container is connected via at least one tether to the at least one seal of the at least one sub-container and wherein opening at least one seal of the at least one sub-container that is rigidly attached to the container and is contained within the container, responsive to the opening a seal of the container comprises: opening at least one seal of the at least one sub-container that is rigidly attached to the container and is contained within the container, responsive to the opening a seal of the container, substantially concurrently with the opening a seal of the container.

In further embodiments, opening at least one seal of the at least one sub-container that is rigidly attached to the container and is contained within the container, responsive to the opening a seal of the container comprises: selectively opening, at a time that is subsequent to a time of opening a seal of the container, at least one seal of the at least one sub-container that is rigidly attached to the container and is contained within the container, responsive to the opening a seal of the container.

According to additional embodiments, the method further comprises altering an orientation of the container from a substantially vertical orientation to a substantially horizontal orientation.

In yet further embodiments, the at least one tether comprises a length that is substantially equal to a straight-line distance between the seal of the container and the at least one seal of the at least one sub-container; whereas in other embodiments, the at least one tether comprises a length that is greater than a straight-line distance between the seal of the container and the at least one seal of the at least one sub-container.

According to additional embodiments of the invention, the first substance comprises beer and the at least one second substance comprises Irish cream and/or whiskey. In yet additional embodiments, the first substance comprises a first alcohol content and the at least one second substance comprises a second alcohol content; wherein the second alcohol content differs from the first alcohol content and, in some embodiments, the second alcohol content is greater than the first alcohol content.

In further embodiments of the invention, selectively opening, at a time that is subsequent to a time of opening a seal of the container, at least one seal of the at least one sub-container that is rigidly attached to the container and is contained within the container, responsive to the opening a seal of the container, comprises: exerting a force, at the time that is subsequent to the time of opening the seal of the container, on at least one tether that is attached to the seal of the container and is also attached to the at least one seal of the at least one sub-container. In yet further embodiments of the invention, opening at least one seal of the at least one sub-container that is rigidly attached to the container and is contained within the container, responsive to the opening a seal of the container, substantially concurrently with the opening a seal of the container, comprises: exerting a force on at least one tether that is attached to the seal of the container and is also attached to the at least one seal of the at least one sub-container, substantially concurrently with the opening a seal of the container.

According to still further embodiments, the method further comprises attaching at least one tether to the seal of the container and attaching the at least one tether to the at least one seal of the at least one sub-container.

According to additional embodiments of the invention, a container apparatus may be provided comprising: a container; a seal that comprises at least one tether that is attached thereto; and at least one sub-container that is rigidly attached to the container and is contained within the container; wherein the at least one sub-container comprises at least one seal that is attached to the at least one tether; wherein the container contains a first substance, the at least one sub-container that is rigidly attached to the container and is contained within the container contains at least one second substance, wherein the at least one seal of the at least one sub-container that is attached to the at least one tether is configured to alter a state thereof responsive to an altered state of the seal of the container and/or responsive to a force that is applied on the at least one tether and wherein mixing of the at least one second substance with the first substance occurs responsive to the altered state of the at least one seal of the at least one sub-container.

According to further embodiments of the invention, seal for a container is provided; the seal comprising: at least one tether that is attached thereto and is also attached to at least one other seal of at least one other container; wherein the at least one other container is configured to fit within the container and to be rigidly attached to the container, the container is configured to include a first substance, the at least one other container is configured to include at least one second substance and wherein mixing of the at least one second substance with the first substance is enabled responsive to a change of state of the seal, responsive to a force that is applied to the at least one tether and responsive to a change of state of the at least one other seal.

DETAILED DESCRIPTION

Figure 1:
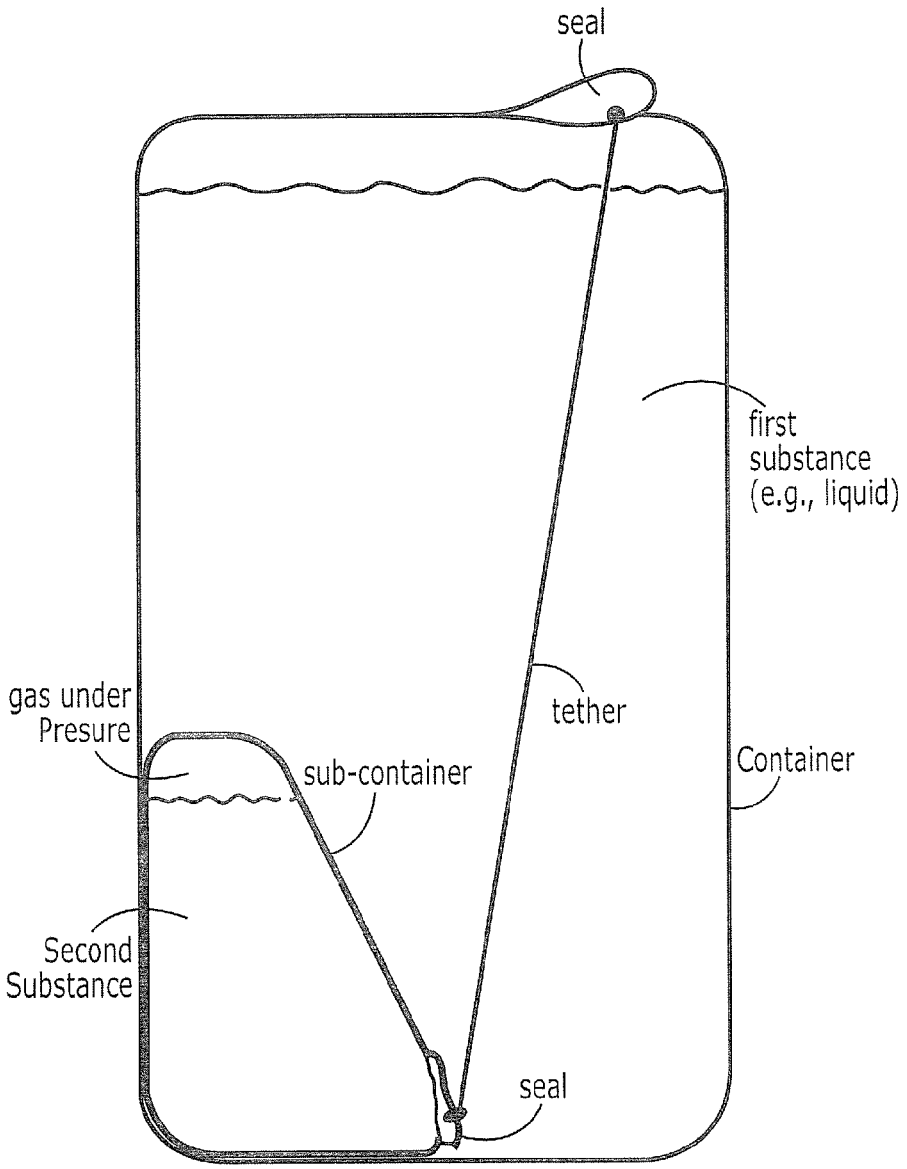
FIGS. 1, 2, 3, 4 and 5 are illustrative of methods, systems, containers, sub-containers, seals and/or tethers according to embodiments of the present invention.

The present invention is based upon a realization that it may be desirable to configure a container to include a substance, such as, for example, a liquid, that may, according to some embodiments of the present invention, be an alcoholic liquid, and to also include one or more sub-containers each one of which includes a substance, such as, for example, a liquid, that may, according to embodiments of the present invention, be an alcoholic liquid. The container may be configured to include a seal that may be an air-tight (or substantially air-tight) seal, to include a first substance that may be in the form of a liquid, to include at least one sub-container each one of which includes at least one seal, that may be an air-tight (or substantially air-tight) seal; the at least one sub-container including at least one second substance that may be in the form of a liquid, wherein the at least one second substance may be under pressure, as may be caused by a gas that has been forced inside of the at least one sub-container, and the container may also be configured to include at least one tether that is connected/attached to the seal of the container and is also connected/attached to the at least one seal of the at least one sub-container. In some embodiments, the substance that is included in the container and/or the at least one second substance that is included in the at least one sub-container may be subject to an absence of pressure, as may be caused by a vacuum that may be created inside of the container and/or inside of the at least one sub-container.

Accordingly, in some embodiments of the present invention, when a state of the seal of the container is altered (e.g., when the seal of the container is pulled, in order to open the container), the at least one tether that is connected/attached to the seal of the container is also pulled (i.e., a force is exerted on the at least one tether) and, owing to a first predetermined length of the at least one tether and to the at least one tether being connected/attached to the at least one seal of the at least one sub-container, at least one seal of the at least one sub-container is pulled/opened (i.e., a state thereof is altered), releasing the at least one second substance from within the at least one sub-container and allowing the at least one second substance to mix with the first substance within the container and/or within the at least one sub-container. According to further embodiments of the present invention, the at least one tether comprises a second predetermined length, wherein the second predetermined length is greater than the first predetermined length, such that when the seal of the container is pulled in order to open the container, the at least one tether that is connected/attached to the seal of the container is also pulled (i.e., experiences a force) but not sufficiently to influence/open and/or to alter/change the state of the at least one seal of the at least one sub-container. Accordingly, embodiments of the present invention comprising at least one tether of the second predetermined length, provide for selectively dispensing the at least one second substance contained by the at least one sub-container by further pulling (i.e., by further exerting a force) on the at least one tether at any desired time following opening of the container.

It will be understood that the at least one sub-container is connected/attached to the container and is within the container. It will further be understood that the at least one sub-container may be rigidly connected/attached to one or more internal surfaces, walls, bottom and/or top of the container so that the at least one sub-container is not able to move (linearly and/or rotationally) relative to the container. It will also be understood that each one of the container, the seal of the container, the at least one tether, the at least one sub-container and the at least one seal of the at least one sub-container may be made of any material and/or combination of materials including, but not limited to, glass, plastic, metal (e.g., aluminum), etc. According to some embodiments of the present invention, each one of the container, the seal of the container, the at least one tether, the at least one sub-container and the at least one seal of the at least one sub-container is made/constructed of metal and/or comprises metal. In further embodiments of the invention, each one of the container and the at least one sub-container is made/constructed of glass and/or comprises glass and each one of the at least one tether, the seal of the container and the at least one seal of the at least one sub-container is made/constructed of metal and/or comprises metal.

FIGS. 1, 2, 3, 4 and 5 are illustrative of embodiments according to the present invention. It will be understood that although specific shapes are associated with the container and the at least one sub-container, as illustrated in FIGS. 1, 2, 3, 4 and 5, any other shape(s) may be used for the container and/or the at least one sub-container according to other embodiments of the present invention. Further, it will be understood that although specific shapes are associated with the seal of the container, the at least one seal of the at least one sub-container and the at least one tether, as illustrated in FIGS. 1, 2, 3, 4 and 5, any other shape(s) may be used for the seal of the container, the at least one seal of the at least one sub-container and/or the at least one tether, according to further embodiments of the invention, and that the at least one tether may, according to some embodiments, be supported/restrained by an inner surface of the container via a mechanical configuration (e.g., via a "loop," which is attached to the inner surface of the container through which the at least one tether is passed), providing the support/restraint. It will further be understood that one or more other locations/positions/configurations for the seal of the container, the at least one seal of the at least one sub-container and/or the at least one tether may be used in yet other embodiments of the invention, as will surely occur to those skilled in the art.

Figure 2:
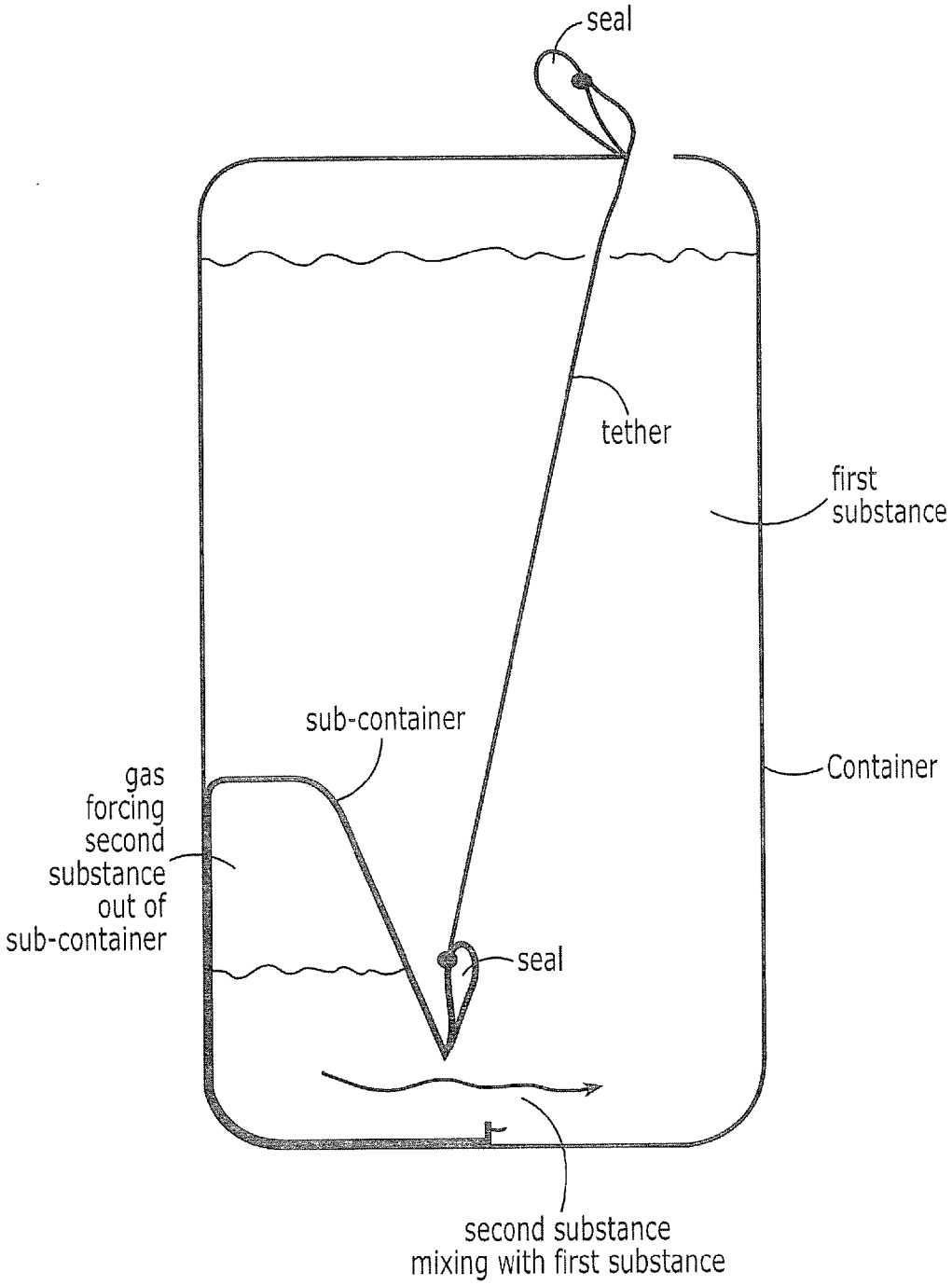

Specifically, FIG. 1 illustrates a container containing a first substance and also containing a sub-container which is rigidly attached to an interior wall of the container; wherein the sub-container contains a second substance and may also contain a gas under pressure, as is illustrated in FIG. 1. Still referring to FIG. 1, a seal of the container includes a tether that is attached thereto and is also attached to a seal of the sub-container. When the seal of the container and the seal of the sub-container are in their closed state, as is illustrated in FIG. 1, the first substance is maintained within the container and the second substance is maintained within the sub-container and the first substance is not allowed to mix with the second substance (or vice versa). When the seal of the container is pulled (i.e., opened), as is illustrated in FIG. 2, the tether that is attached thereto is also pulled, exerting a force on the seal of the sub-container, thus pulling and opening the seal of the sub-container, as is illustrated in FIG. 2, and allowing for the mixing of the second substance with the first substance, particularly as the container is tilted, as may be performed by a person in order to drink from the container.

Figure 3:
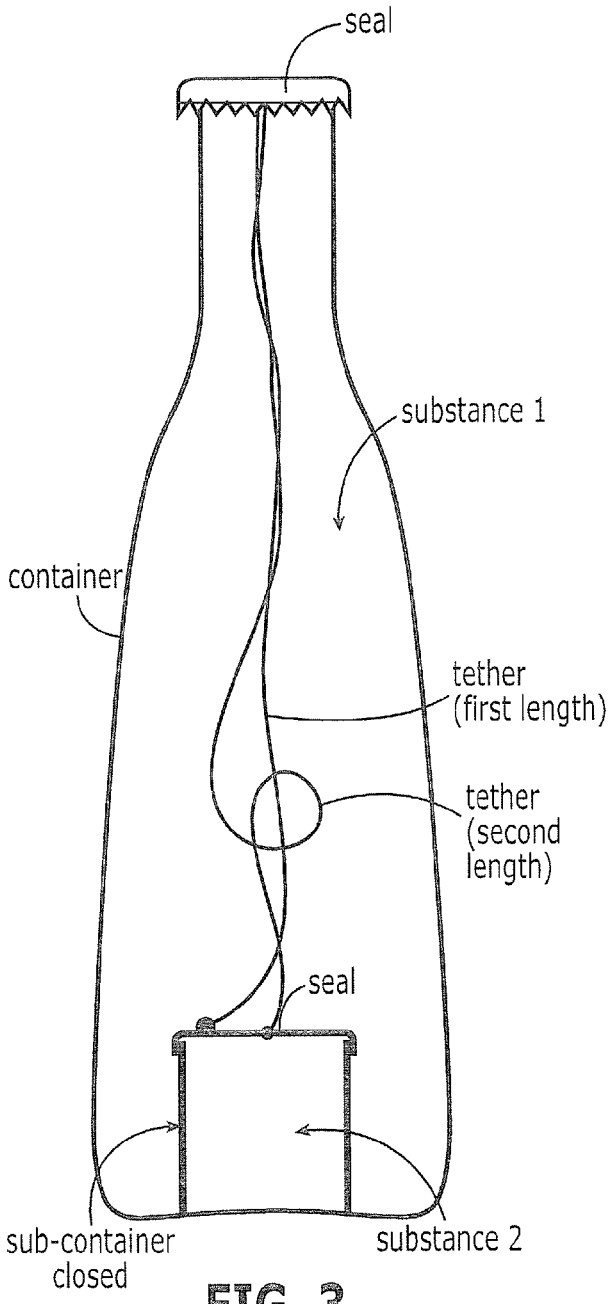

Referring now to FIG. 3, wherein additional embodiments of the invention are illustrated, the seal of the container may be connected to the seal of the sub-container via a tether comprising a first length and/or a tether comprising a second length. In some embodiments, only one of the two tethers may be used; either the tether comprising the first length or the tether comprising the second length. As is illustrated in FIG. 3, the tether comprising the second length is longer than the tether comprising the first length. Accordingly, in embodiments of the invention wherein the tether comprising the second length is used, the seal of the container may be opened without necessarily also opening, pulling and/or exerting a force on the seal of the sub-container. Thus, embodiments using the longer tether provide for selectively and/or preferentially opening of the seal of the sub-container at a time (at any time) following the opening of the seal of the container.

Figure 4:
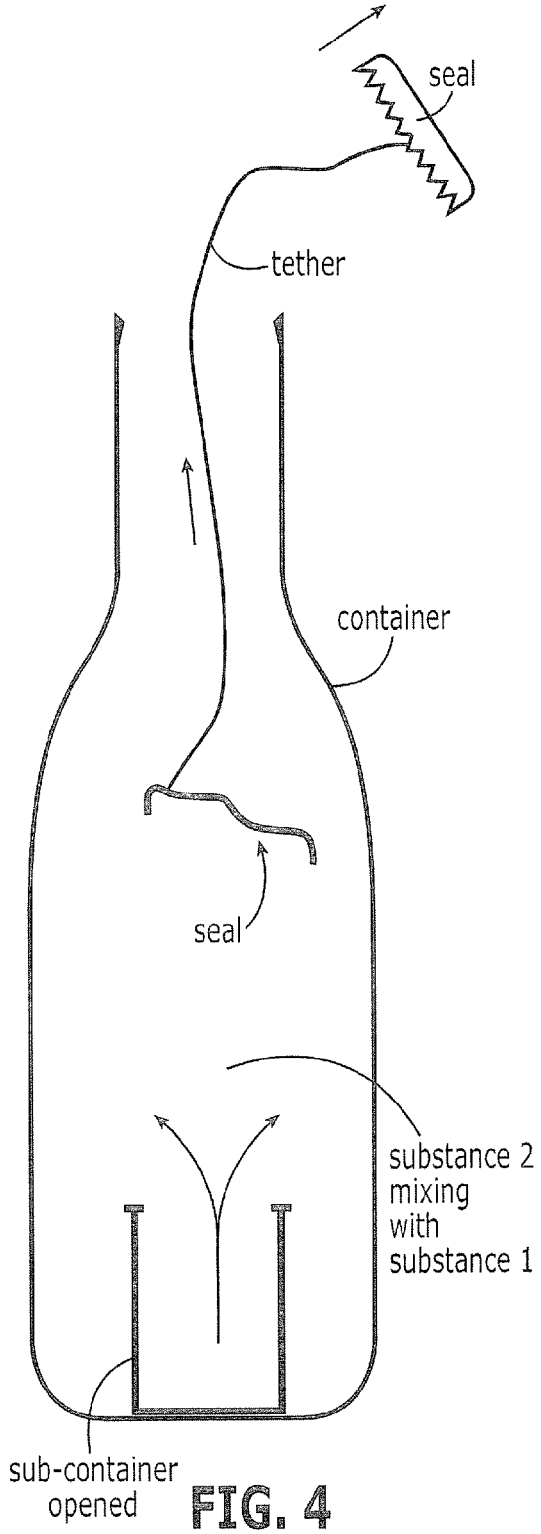
Figure 5:
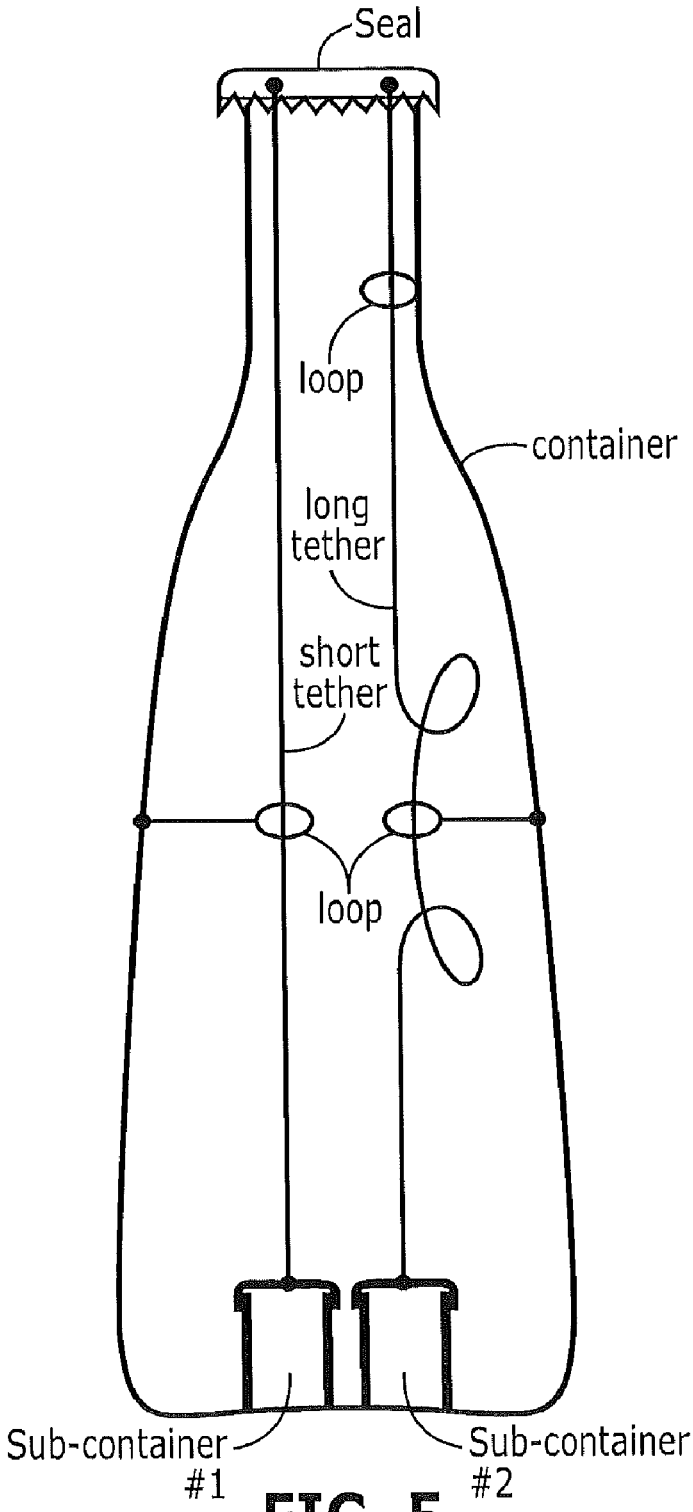

FIG. 4 illustrates a single tether connecting a substantially rigid seal of the container (e.g., a seal of the container along the lines of seals currently being used on glass beer bottles and/or other bottles) with a substantially flexible/malleable seal of the sub-container, wherein the seal of the container and the seal of the sub-container are illustrated as having been removed (opened) allowing for mixing of substance 1 with substance 2. In some embodiments, the seal of the sub-container may be substantially flexible and/or malleable so as to easily deform upon being pulled. This flexible and/or malleable feature of the seal of the sub-container may aid in opening and/or removing the seal of the sub-container from the sub-container and may also aid in removing the seal of the sub-container from within the container via the opening of the container that is produced by removing the seal of the container. In some embodiments, the seal of the sub-container and/or the tether may comprise one or more materials at least one of which is inert to the first substance (substance 1) and/or to the second substance (substance 2), and the seal of the sub-container and/or the tether may comprise plastic and/or aluminum. It will be understood that any element(s) of any one or more of the Figures/embodiments that are described herein may be combined with any other element(s) of any one or more of other Figures/embodiments that are described herein to provide one or more additional embodiments. Thus, for example, FIG. 5 illustrates an embodiment that includes a first sub-container, a first tether, a second sub-container and a second tether that is longer than the first tether. Supporting/restraining loops are also illustrated.

Accordingly, many different embodiments stem from the above description and the accompanying drawings. It will be understood that it would be unduly repetitious and obfuscating to literally describe and illustrate every combination, sub-combination and variation of these embodiments. Accordingly, the present specification, including the drawings, shall be construed to constitute a complete written description of all combinations, sub-combinations and variations of the embodiments described herein, and of the manner and process of making and using them, and shall support claims to any such combination, sub-combination or variation.

The present invention has been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

When an element is referred to as being coupled or connected to/with another element, it can be directly coupled or connected to/with the other element or intervening elements may also be present. In contrast, if an element is referred to as being directly coupled or connected to/with another element, then no other intervening elements are present. As used herein, the term "and/or" includes any and all combinations of one or more of the associated listed items. The symbol "/" is also used as a shorthand notation for "and/or".

It will be understood that although terms such as first and second are used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer and/or section that may be discussed herein could be termed a second element, component, region, layer and/or section, and similarly, a second element, component, region, layer and/or section could be termed a first element, component, region, layer and/or section without departing from the teachings of the present invention. Like numbers refer to like elements throughout.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In the specification and the drawings, there have been disclosed embodiments of the invention and, although specific terms are employed, they are used in a generic and descriptive sense only and not for purposes of limitation; the scope of the invention being set forth in the following claims.

What is claimed is:

1. A method of mixing a first substance that is contained within a container with a second substance that is contained within a first sub-container that is rigidly attached to the container and is contained within the container and with a third substance that is contained within a second sub-container that is rigidly attached to the container and is contained within the container, the method comprising:

opening a first seal of the first sub-container responsive to opening a seal of the container, by pulling on a first tether that is attached to the seal of the container and to the first seal of the first sub-container, without opening a second seal of the second sub-container that is attached to the seal of the container by a second tether that is longer than the first tether; and opening the second seal of the second sub-container in response to pulling the seal of the container that was opened, to cause the second tether that is longer than the first tether to open the second seal of the second sub-container.

2. A method according to claim 1, wherein the first sub-container contains gas under pressure.

3. A method according to claim 1, wherein opening a first seal of the first sub-container, responsive to opening a seal of the container comprises:

opening the first seal of the first sub-container, directly responsive to the opening a seal of the container, and substantially concurrently with the opening a seal of the container.

4. A method according to claim 1, wherein opening the second seal of the second sub-container comprises:

selectively opening, at a time that is subsequent to a time of the opening a seal of the container, the second seal of the second sub-container.

5. A method according to claim 1, further comprising:

altering an orientation of the container from a substantially vertical orientation to a substantially horizontal orientation.

6. A method according to claim 1, wherein the first tether comprises a length that is substantially equal to a straight-line distance between the seal of the container and the first seal of the first sub-container.

7. A method according to claim 1, wherein the second tether comprises a length that is greater than a straight-line distance between the seal of the container and the second seal of the second sub-container.

8. A method according to claim 1, wherein the first substance comprises beer and wherein the second substance comprises Irish cream and/or whiskey.

9. A method according to claim 1, wherein the first substance comprises a first alcohol content, the second substance comprises a second alcohol content and wherein the second alcohol content differs from the first alcohol content.

10. A method according to claim 9, wherein the second alcohol content is greater than the first alcohol content.

11. A container apparatus comprising:

a container;

a seal;

a first tether and a second tether that is longer than the first tether that are attached to the seal;

a first sub-container that is rigidly attached to the container and is contained within the container; wherein the first sub-container comprises a first seal that is attached to the first tether; and a second sub-container that is rigidly attached to the container and is contained within the container; wherein the second sub-container comprises a second seal that is attached to the second tether that is longer than the first tether;

wherein the container contains a first substance, the first sub-container that is rigidly attached to the container and is contained within the container contains at least one second substance, and the second sub-container that is rigidly attached to the container and is contained within the container contains at least one third substance.

12. A container apparatus according to claim 11, wherein the first substance comprises beer and wherein the at least one second substance comprises Irish cream and/or whiskey.

13. A container apparatus according to claim 11, wherein the first substance comprises a first alcohol content, the at least one second substance comprises a second alcohol content and wherein the second alcohol content differs from the first alcohol content.

14. A container apparatus according to claim 13, wherein the second alcohol content is greater than the first alcohol content.

15. A container apparatus according to claim 11, wherein the first seal of the first sub-container that is attached to the first tether is configured to open, directly responsive to opening of the seal of the container, and substantially concurrently with the opening of the seal of the container.

16. A container apparatus according to claim 11, wherein the second seal of the second sub-container that is attached to the second tether is configured to open, responsive to pulling of the seal of the container, substantially at a later time relative to a time of the opening of the seal of the container.

17. A container apparatus according to claim 11, wherein the first tether comprises a length that is substantially equal to a straight-line distance between the seal of the container and the first seal of the first sub-container.

18. A container apparatus according to claim 11, wherein the second tether comprises a length that is greater than a straight-line distance between the seal of the container and the second seal of the second sub-container.

19. A method according to claim 1, further comprising:

supporting and slidably restraining the first tether and/or the second tether by an inner surface of the container.

20. A container apparatus according to claim 11, wherein an inner surface of the container is configured to support and slidably restrain the first and/or second tether.

* * * * *